US006446827B1

(12) United States Patent
Akins

(10) Patent No.: US 6,446,827 B1
(45) Date of Patent: Sep. 10, 2002

(54) PAINT CONTAINER AND DISPENSER APPARATUS FOR USE WITH A PAINT BRUSH

(76) Inventor: R. W. Akins, 77 N. Conalco, Jackson, TN (US) 38301

( * ) Notice: Subject to any disclaimer, the term of this patent is extended or adjusted under 35 U.S.C. 154(b) by 0 days.

(21) Appl. No.: 09/970,050

(22) Filed: Oct. 3, 2001

(51) Int. Cl.[7] ..... B65D 51/00
(52) U.S. Cl. ..... 220/570; 220/698; 220/719
(58) Field of Search ..... 220/570, 256, 220/703, 698, 719, 734, 560.03; 206/1.7, 1.8

(56) References Cited

U.S. PATENT DOCUMENTS

| | | | | | |
|---|---|---|---|---|---|
| 599,461 | A | * | 2/1898 | Thomas | 220/698 X |
| 665,438 | A | * | 1/1901 | Higgins | 220/698 |
| 1,254,714 | A | * | 1/1918 | McCombs | 220/698 X |
| 2,151,895 | A | * | 3/1939 | Carlson | 220/698 X |
| 2,674,757 | A | | 4/1954 | Keyes, Jr. | 15/121.2 |
| 3,464,599 | A | | 9/1969 | Meth | 222/589 |
| 3,543,287 | A | * | 11/1970 | Henkel | 220/698 |
| 5,678,684 | A | | 10/1997 | Wright | 206/204 |
| 5,758,797 | A | * | 6/1998 | Martindale | 220/719 |
| 5,855,304 | A | * | 1/1999 | Dean et al. | 220/570 X |
| 6,032,827 | A | | 3/2000 | Zettle et al. | 220/788 |
| 6,142,332 | A | | 11/2000 | Ferrara | 220/212 |

FOREIGN PATENT DOCUMENTS

| | | | |
|---|---|---|---|
| EP | 0504941 A1 | 9/1992 | B44D/3/12 |
| GB | 1 428 356 | 3/1976 | |
| JP | 11-227388 | 8/1999 | |

* cited by examiner

*Primary Examiner*—Steven Pollard
(74) *Attorney, Agent, or Firm*—Garvey, Smith, Nehrbass & Doody, L.L.C.

(57) ABSTRACT

A no spill paint container and dispenser apparatus is provided for use with a paint brush. The apparatus includes a receptacle having an interior for containing paint, a side or side portions, a bottom portion and an open top surrounded by a peripheral edge. The edge includes a smooth and uninterrupted outwardly extending lip. The first cover fits the receptacle at the peripheral edge, the first cover having a transverse top panel. A peripheral skirt depends from the periphery of the transverse top panel. A funnel shaped member is mounted to the transverse top panel, the funnel member having open ended portions that enable a paintbrush to be inserted through the first cover to access paint contained within the receptacle interior. The first cover includes a pair of ceiling beads that are positioned respectively on the transverse top panel and skirt panel. The beads defining a recess there between that is sized and shaped to receive the receptacle lip. A second cover fits over and seals the first cover.

25 Claims, 2 Drawing Sheets

PAINT CONTAINER AND DISPENSER APPARATUS FOR USE WITH A PAINT BRUSH

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to paint dispensers, painting cups, and like vessels that are adapted for use with paint brushes. More particularly, the present invention relates to an improved spill-proof paint cup that can be used by preschool age children, wherein a receptacle of improved configuration includes a receptacle and a pair of covers, one of the covers providing a funnel shaped opening through which a paint brush can be inserted to access paint contained in the receptacle, the other cover forming a seal over the first cover.

2. General Background of the Invention

Preschool, kindergarten, and elementary school children are typically exposed to classroom art classes that include painting exercises using an artist style paintbrush. These small children are typically exposed to painting at a very early age. In such pre-school art classes, paint holding containers are frequently spilled when the user inadvertently tips the container over with a typically messy result. Several paint dispensing containers that are designed for use with a paintbrush have attempted to address the problem of spillage.

The Keyes U.S. Pat. No. 2674,757 discloses a paint dispensing device and more particularly a container for paint and the like having a well formed therein into which a metered quantity of paint may be introduced.

The Meth U.S. Pat. No. 3,464,599 discloses a spill proof container, particularly a container for liquids such as poster paints, inks, etc. which are used by children in a container which if tilted or knocked over by the user will not spill the liquid contents. The contents are removable from the interior of the container only by use of an exterior member such as a paintbrush.

U.S. Pat. No. 5,678,684 provides a spill proof container for use with paint or liquids of comparable viscosity. In particular, the container of the '684 patent includes a receptacle having a base portion and a top portion, an insert member with a generally central aperture attached to the top portion of the receptacle, and a barrier member having a hole formed there through operatively connected to the insert member. The hole in the barrier member permits the user to access the liquid within the container with a brush or like instrument, while the barrier member functions like an obstruction which prevents or minimizes spillage should the container be tipped over or inverted. The barrier member may alternatively be constructed of an absorbent sponge or solid plastic material. A lid is also provided so that the user may conveniently open and reseal the container.

U.S. Pat. No. 6,032,827 entitled "Container having a selectively attachable lid including a rigid tab member" includes a container combination of a bowl and selectively attachable lid. The bowl is a unitary structure including an upperly projecting wall having a peripherally extending substantial unshaped sealing lip. The selectively detachable lid is also a unitary structure including a body having a peripheral sealing lip which mates with a sealing lip of the bowl and at least one laterally extending tab member to assist in removing the lid from the bowl. Both the bowl and lid portions are preferably made from a resilient polymer material suitable for both freezing and microwave reheating.

The Ferrara U.S. Pat. No. 6,142,332 discloses a container lid and cutting board apparatus.

A Japanese patent number 11-227388 discloses a container that includes three parts. The three parts include a vessel having an interior for containing a liquid, an upper rim having an external thread, an insert that is placed during use into the container, the insert having a peripheral flange that seats upon the upper edge of the vessel. A closure cap provides central opening that enables an instrument such as a paint brush to be inserted through the opening, through the insert into a liquid that is contained within the vessel. The insert includes a funnel fit portion having open ended portions.

A non-spill open topped container is disclosed in British patent 1,428,356.

A European patent application 0504941A1 discloses a paint container that comprises a can and a removable lid consisting of a closure member in the shape of a well having an outer wall through which a hole above a certain level enables paint to enter the well from within the can when the latter is tilted. The hole acts as a weir to limit the depth of paint into the well to said level.

BRIEF SUMMARY OF THE INVENTION

The invention is embodied in a non-spill paint cup for use primarily by pre-schoolers and elementary school students of the early grades.

The cup can be generally rectangular (preferably square) in vertical cross section, having gently outwardly sloping walls. The corners of the rectangular cross section can be rounded.

An inkwell cap having a configuration complimentary to the cup provides a downwardly extending rim with an internal annular complimentary to the cup rim whereby the cap may be secured in a sealed relation to the cup rim.

Disposed preferably centrally in the cap is a downwardly extending funnel, the opening of which is large enough to accept an artist's paintbrush (eg. approximately ½ inches in diameter) to be dipped into paint contained in the cup and withdrawn therefrom without interference of the funnel.

An air-tight cover of a rectangular configuration, complimentary to the cap and having downwardly extending sides, is adapted to be received over the downwardly extending sides of the cap in a tight fit. The cover in the preferred embodiment can include a pull tab to assist in the removal of only the cover.

The cup is preferably made of a translucent material and includes a fill line indicating the level of liquid contents which may be inserted and not flow out if the cup is tilted on its side. The height of the fill line may be set in relation to the depth and volume of the funnel such that the cup might be set on its cap and liquid still not run out of the funnel opening.

The present invention thus provides an improved paint container and dispenser apparatus adapted for use with a paintbrush. The apparatus includes a receptacle or vessel that has an interior for containing paint, a side portion, a bottom portion and an open top.

The open top is surrounded by a peripheral edge, the edge having an outwardly extending lip.

A first cover fits the receptacle at the peripheral edge, the first cover having a transverse top, a peripheral skirt that depends from the transverse top, and a funnel shaped member mounted on the transverse top. The funnel includes open ended portions that enable a paintbrush to be inserted through the first cover to access paint contained within the receptacle interior.

The first cover includes a pair of sealing beads that are positioned respectively on the transverse top and on the peripheral skirt. The beads define a recess there between that is sized and shaped to receive the receptacle lip during use and in a closed position.

A second cover or cap is provided that fits over and seals the first cover to effectively seal the paint contained within the receptacle interior.

There can be provided a pair of ridges on the first cover that have a groove there between that enables a paintbrush to be cradled and supported between the ridges while the paintbrush occupies the groove.

The funnel preferably has a conical shape, preferably a frustroconical shape.

The funnel is preferably positioned at the central portion of the first cover.

The transverse top has an undersurface, and one of the beads depends from the undersurface.

The first cover includes a peripheral skirt that has an inside surface and wherein one of the beads extends from the inside surface.

The receptacle can provide a maximum level fill line and a selected liquid capacity below the fill line so that when the receptacle is filled to the fill line, the funnel prevents the dispensing of paint from the container if the receptacle is tipped over to rest upon its side.

One of the beads is preferably a continuous bead that extends about the first cover. In the preferred embodiment, both of the beads can be continuous beads that extend about the first cover.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
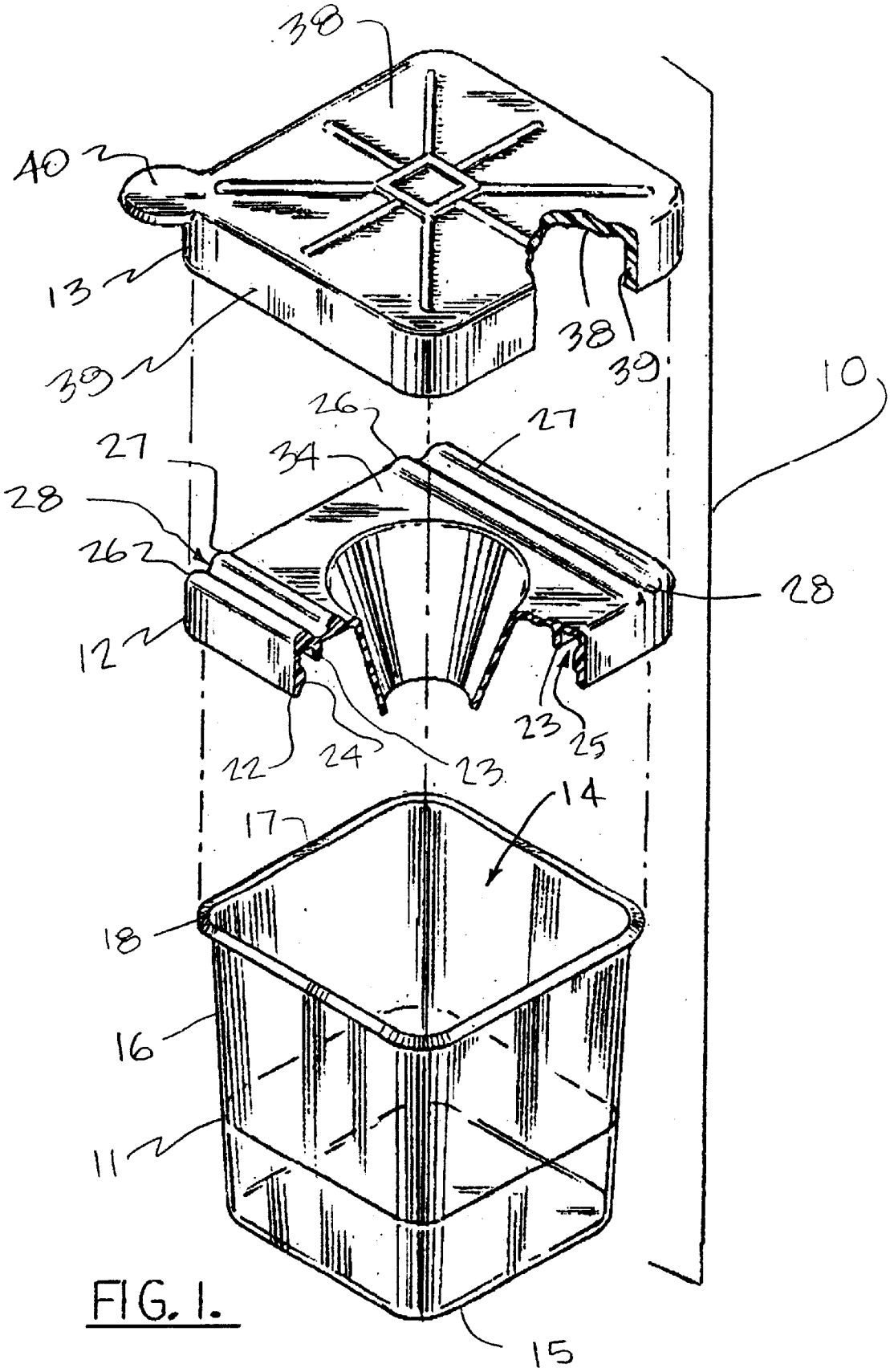
FIG. 1 is a perspective exploded view of the preferred embodiment of the apparatus of the present invention.
Figure 2:
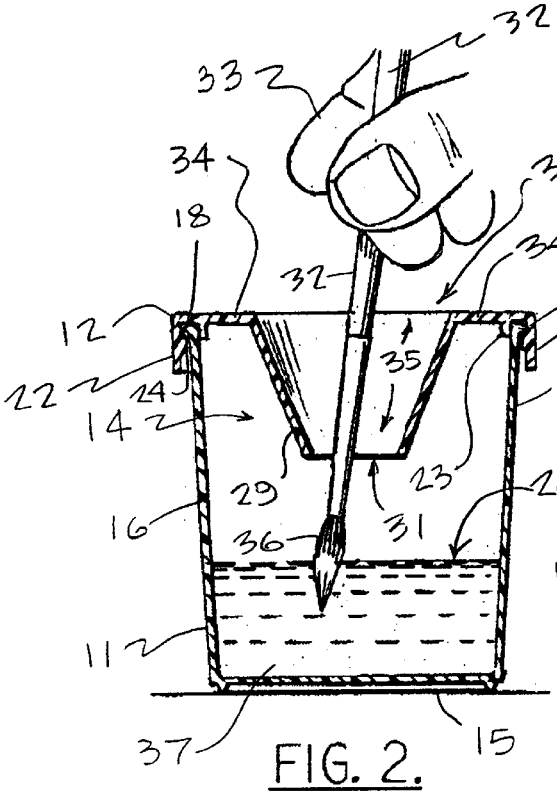
FIG. 2 is a sectional elevation view of the preferred embodiment of the apparatus of the present invention showing the receptacle in an upright position and during use.
Figure 3:
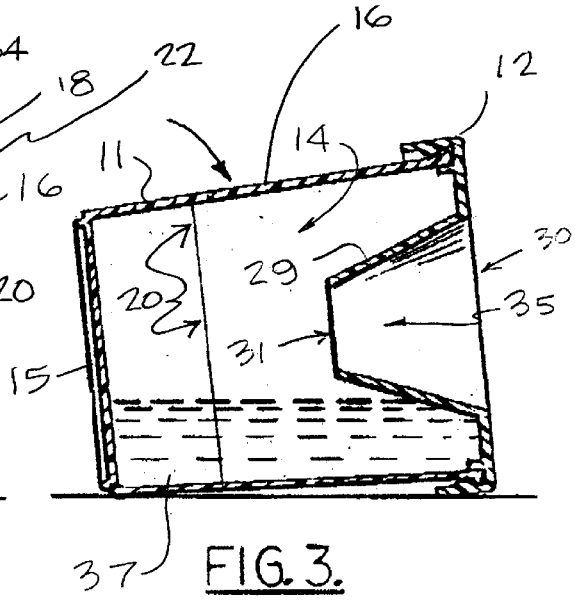
FIG. 3 is a sectional elevation view of the preferred embodiment of the apparatus of the present invention showing the receptacle in a tipped over position.
Figure 4:
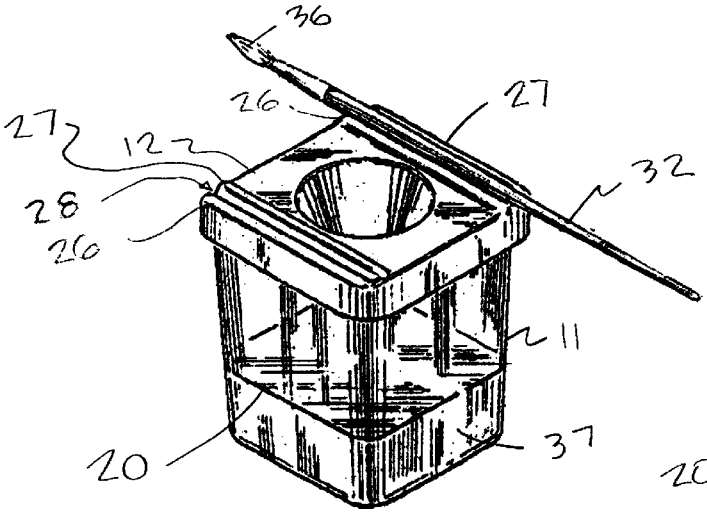
FIG. 4 is a perspective view of the preferred embodiment of the apparatus of the present invention showing the second cover removed.

FIGS. 1–4 show the preferred embodiment of the apparatus of the present invention designated generally by the numeral 10. Paint and art brush container apparatus 10 includes a receptacle 11 that can be fitted with a first cover 12 and a second cover 13. The receptacle 11 has an interior 14, bottom 15 and side walls 16. The side walls 16 can be cylindrically shaped, or are preferably squared or rectangular as shown having a plurality of side walls 16 hat can be flat to impede the container 10 from rolling on a table or desk if tipped over.

The receptacle 11 has an upper rim 17 with an outwardly extending lip 18. The outwardly extending lip 18 is preferably a continuous lip that forms a seal with the first cover 12 at recess 25 in between beads 23, 24. First cover 12 has a transverse top panel 34 with upper surface 21.

A peripheral skirt 22 extends downwardly from transverse panel 34. The peripheral skirt 22 of the first cover 12 can provide an inwardly extending bead 24. Another bead 23 is provided as a downwardly extending bead that extends downwardly from a transverse panel 34 portion of first cover 12. A recess 25 is provided in between the downwardly extending bead 23 and the inwardly extending bead 24. This recess 25 receives the outwardly extending lip 18 of upper rim 17 of receptacle 11.

In order to support a paintbrush 32 upon the first cover 12, a pair of ridges 26, 27 are provided with a groove 28 there between. As shown in the drawings (FIG. 4), the paintbrush 32 can simply be placed into the groove 28 so that it is cradled by the two spaced apart ridges 26, 27.

A funnel wall 29 surrounds a passageway 35 through which the paintbrush 32 can be inserted in order to access paint contained within the receptacle 11 interior 14. Funnel wall 29 defines an open-ended annular structure having an upper opening 30 and a lower opening 31. In this fashion, a user 33 can grip the paintbrush 32 and insert the bristles 36 through the passage way 35 to access paint contained within interior 14.

If a preschool child, elementary school child, or other small child inadvertently tips the container 10 onto one of its sides 16 as indicated schematically, the funnel wall 29 is sized and shaped to prevent paint from being dispensed from the container 10 via openings 30, 31. Fill line 20 defines a maximum volume that would be contained within the receptacle 11 interior 14 and not escape through passageway 35.

Figure 5:
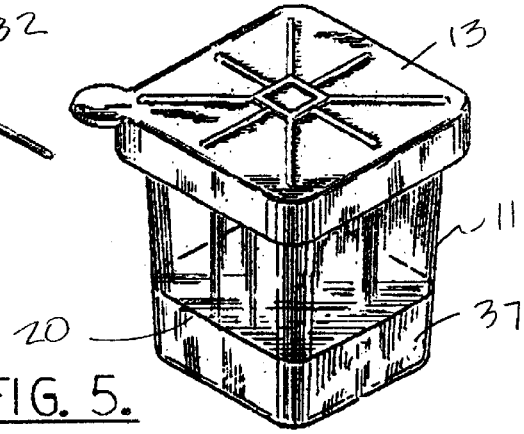
FIG. 5 is a perspective view of the preferred embodiment of the apparatus of the present invention.

Second cover or cap 13 is preferably made of a soft vinyl material and is comprised of a transverse top panel 38, peripheral skirt 39, and a removable tab 40. As shown in FIGS. 1 and 5, the cap 13 is preferably under sized with respect to the perimeter of first cover 12 to provide a slight interference fit. Cap 13 forms a seal over the first cover 12 when the peripheral skirt 13 of cap 13 aligns with and comes into face to face contact with the peripheral skirt 22 of first cover 12.

PARTS LIST

10 no-spill painting container apparatus
11 receptacle
12 first cover
13 second cover
14 interior
15 bottom
16 side wall
17 upper rim

18 outwardly extending lip
19 laterally extending portion
20 fill line
21 upper surface
22 peripheral skirt
23 downwardly extending bead
24 inwardly extending bead
25 recess
26 ridge
27 ridge
28 groove
29 funnel wall
30 upper opening
31 lower opening
32 paintbrush
33 user
34 transverse panel
35 passageway
36 bristles
37 paint
38 top panel
39 peripheral skirt
40 removal tab The following is a list of suitable parts and materials for the various elements of the preferred embodiment of the present invention.

The going embodiments are presented by way of example only; the scope of the present invention is to be limited only by the following claims.

What is claimed is:

1. A paint container and dispenser apparatus for use with a paintbrush comprising:

a) a receptacle having an interior for containing paint, a side portion, a bottom portion, and an open top surrounded by a peripheral edge, the edge having an outwardly extending lip;

b) a first cover that fits the receptacle at the peripheral edge, the first cover having a transverse top panel, a peripheral skirt that depends from the transverse top panel, and a funnel shaped member mounted to the transverse top panel, the funnel having open ended portions that enable a paintbrush to be inserted through the first cover to access paint contained within the receptacle interior;

c) the first cover having a pair of sealing beads that are positioned respectively on the transverse top panel and skirt, said beads defining a recess there between that is sized and shaped to receive the receptacle lip; and d) a second cover that fits over and seals the first cover.

2. The apparatus of claim 1 wherein there are a pair of ridges on the first cover having a groove there between that enables a paintbrush to be cradled and supported upon the first cover at the groove.

3. The apparatus of claim 1 wherein the funnel has a generally conically shaped wall portion.

4. The apparatus of claim 1 wherein the funnel is positioned at the central portion of the first cover.

5. The apparatus of claim 1 wherein the transverse top panel has an undersurface, and one of the beads depends from said undersurface.

6. The apparatus of claim 1 wherein the first cover peripheral skirt has an inside surface and wherein one of the beads extends from the inside surface.

7. The apparatus of claim 1 further comprising a groove on the first cover that enables a paintbrush to be supported upon the first cover.

8. The apparatus of claim 1 wherein the receptacle has a maximum level fill line and a liquid capacity when the receptacle is filled to the fill line and wherein the funnel prevents the dispensing of paint from the container when the receptacle is tipped over to rest upon the side.

9. The apparatus of claim 1 wherein one of the beads is a continuous bead that extends about the first cover.

10. The apparatus of claim 1 wherein both of the beads are continuous beads that extend about the first cover.

11. The apparatus of claim 1 wherein the receptacle has a plurality of flat sides to prevent the receptacle from rolling if it is tipped over.

12. The apparatus of claim 1 wherein the second cover forms an interference fit with the first cover.

13. A paint container and dispenser apparatus for use with a paintbrush comprising:

a) a receptacle having an interior for containing paint, a side portion, a bottom portion, and an open top surrounded by a peripheral edge, the edge having an outwardly extending lip;

b) a first cover that fits the receptacle at the peripheral edge, the first cover having a transverse top, a peripheral skirt that depends from the transverse top, and a funnel shaped member mounted to the transverse top, the funnel having open ended portions that enable a paintbrush to be inserted through the first cover to access paint contained within the receptacle interior;

c) the first cover having sealing bead means for forming a fluid tight seal between the first cover and the receptacle at the edge and lip; and d) a second cover that fits over and seals the first cover.

14. The apparatus of claim 13 wherein there are a pair of ridges on the first cover having a groove there between that enables a paintbrush to be cradled and supported upon the first cover at the groove.

15. The apparatus of claim 13 wherein the funnel has a generally conically shaped wall portion.

16. The apparatus of claim 13 wherein the funnel is positioned at the central portion of the first cover.

17. The apparatus of claim 13 wherein the transverse top panel has an undersurface, and one of the beads depends from said undersurface.

18. The apparatus of claim 13 wherein the first cover peripheral skirt has an inside surface and wherein one of the beads extends from the inside surface.

19. The apparatus of claim 13 further comprising a groove on the first cover that enables a paintbrush to be supported upon the first cover.

20. The apparatus of claim 13 wherein the receptacle has a maximum level fill line and a liquid capacity when the receptacle is filled to the fill line and wherein the funnel prevents the dispensing of paint from the container when the receptacle is tipped over to rest upon the side.

21. The apparatus of claim 13 wherein one of the beads is a continuous bead that extends about the first cover.

22. The apparatus of claim 13 wherein both of the beads are continuous beads that extend about the first cover.

23. The apparatus of claim 13 wherein the receptacle has a plurality of flat sides to prevent the receptacle from rolling if it is tipped over.

24. The apparatus of claim 1 wherein the second cover forms an interference fit with the first cover.

25. A paint container and dispenser apparatus for use with a paintbrush comprising:

a) a receptacle having an interior for containing paint, a side portion, a bottom portion, and an open top surrounded by a peripheral edge, the edge having an outwardly extending lip;

b) a first cover that fits the receptacle at the peripheral edge, the first cover having a transverse top, a peripheral skirt that depends from the transverse top, and a funnel shaped member mounted to the transverse top, the funnel having open ended portions that enable a paintbrush to be inserted through the first cover to access paint contained within the receptacle interior;

c) the first cover having a plurality of circumferential beads that enables a seal to be perfected with the peripheral outwardly extending edge and lip; and d) a second cover that fits over and seals the first cover.

* * * * *